US011289064B2

(12) United States Patent
Doglio et al.

(10) Patent No.: US 11,289,064 B2
(45) Date of Patent: Mar. 29, 2022

(54) SYSTEMS AND METHODS FOR VIBRATIONAL AND ACOUSTIC DAMPING WITH BAFFLE STRUCTURE

(71) Applicant: Dell Products L.P., Round Rock, TX (US)

(72) Inventors: Jean Marie Doglio, Round Rock, TX (US); Daniel J. Carey, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 576 days.

(21) Appl. No.: 16/237,466

(22) Filed: Dec. 31, 2018

(65) Prior Publication Data

US 2020/0211523 A1 Jul. 2, 2020

(51) Int. Cl.
*G10K 11/16* (2006.01)
*G10K 11/162* (2006.01)

(52) U.S. Cl.
CPC ..... *G10K 11/161* (2013.01); *G10K 11/162* (2013.01)

(58) Field of Classification Search
CPC ..... G10K 11/161; G10K 11/162
USPC ..... 181/264, 224, 225
See application file for complete search history.

(56) References Cited

U.S. PATENT DOCUMENTS

| | | | | |
|---|---|---|---|---|
| 3,779,341 | A * | 12/1973 | Huggins | F04D 29/663 181/225 |
| 7,021,895 | B2 * | 4/2006 | Rubenstein | F04D 25/166 415/207 |
| 7,161,801 | B2 * | 1/2007 | Chen | G06F 1/20 181/198 |
| 7,929,295 | B2 * | 4/2011 | Joshi | F04D 25/166 361/679.5 |
| 8,144,465 | B2 * | 3/2012 | Liang | G06F 1/20 361/692 |
| 10,041,697 | B1 * | 8/2018 | Black | F24F 13/24 |
| 2008/0230305 | A1 * | 9/2008 | Goto | F24F 13/24 181/224 |
| 2010/0018798 | A1 * | 1/2010 | Jeon | E02F 9/0866 181/225 |
| 2010/0078258 | A1 * | 4/2010 | Tanabe | G10K 11/172 181/224 |
| 2015/0230675 | A1 * | 8/2015 | Van Den Bosch | A47L 9/0081 15/326 |

* cited by examiner

*Primary Examiner* — Forrest M Phillips
(74) *Attorney, Agent, or Firm* — Jackson Walker L.L.P.

(57) ABSTRACT

An acoustical/vibrational noise reduction system may include a plurality of divider walls spaced from each other, generally parallel to each other, and generally parallel to a direction of transmission of acoustical and vibrational noise from a source of acoustical and vibrational energy and an information handling resource. The acoustical/vibrational noise reduction system may also include a plurality of baffle fins mechanically coupled to the plurality of divider walls, generally perpendicular to the plurality of divider walls, and substantially non-parallel to the direction of transmission of acoustical and vibrational noise from the source of acoustical and vibrational energy and the information handling resource.

21 Claims, 4 Drawing Sheets

SYSTEMS AND METHODS FOR VIBRATIONAL AND ACOUSTIC DAMPING WITH BAFFLE STRUCTURE

TECHNICAL FIELD

The present disclosure relates in general to information handling systems, and more particularly to minimizing vibrational and acoustic noise caused by an acoustical and vibrational energy source.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

As processors, graphics cards, random access memory (RAM) and other components in information handling systems have increased in clock speed and power consumption, the amount of heat produced by such components as a side-effect of normal operation has also increased. Often, the temperatures of these components need to be kept within a reasonable range to prevent overheating, instability, malfunction and damage leading to a shortened component lifespan. Accordingly, cooling fans and blowers, referred to generally herein as "air movers," have often been used in information handling systems to cool information handling systems and their components.

Over time, more features are packed into information handling systems, increasing cooling requirements. Accordingly, air movers are required to operate at increasing speeds, leading to increased vibrational and acoustical noise generated by information handling systems. Such increased vibrational and acoustical noise may be detrimental to the operation of some information handling systems components, including without limitation hard disk drives. Accordingly, solutions that mitigate vibrational and acoustical transmission by air movers and other sources of vibrational and acoustical energy are desired.

SUMMARY

In accordance with the teachings of the present disclosure, the disadvantages and problems associated traditional approaches to minimizing vibrational and acoustical damping in an information handling system may be substantially reduced or eliminated.

In accordance with embodiments of the present disclosure, an information handling system may include a chassis and an acoustical/vibrational noise reduction system mechanically coupled within the chassis and located between a source of acoustical and vibrational energy and an information handling resource of the information handling system. The acoustical/vibrational noise reduction system may include a plurality of divider walls spaced from each other, generally parallel to each other, and generally parallel to a direction of transmission of acoustical and vibrational noise from the source of acoustical and vibrational energy and the information handling resource. The acoustical/vibrational noise reduction system may also include a plurality of baffle fins mechanically coupled to the plurality of divider walls, generally perpendicular to the plurality of divider walls, and substantially non-parallel to the direction of transmission of acoustical and vibrational noise from the source of acoustical and vibrational energy and the information handling resource.

In accordance with these and other embodiments of the present disclosure, an acoustical/vibrational noise reduction system may include a plurality of divider walls spaced from each other, generally parallel to each other, and generally parallel to a direction of transmission of acoustical and vibrational noise from a source of acoustical and vibrational energy and an information handling resource. The acoustical/vibrational noise reduction system may also include a plurality of baffle fins mechanically coupled to the plurality of divider walls, generally perpendicular to the plurality of divider walls, and substantially non-parallel to the direction of transmission of acoustical and vibrational noise from the source of acoustical and vibrational energy and the information handling resource.

In accordance with these and other embodiments of the present disclosure, a method may include arranging a plurality of divider walls spaced from each other, generally parallel to each other, and generally parallel to a direction of transmission of acoustical and vibrational noise from a source of acoustical and vibrational energy and an information handling resource. The method may also include mechanically coupling a plurality of baffle fins to the plurality of divider walls, generally perpendicular to the plurality of divider walls, and substantially non-parallel to the direction of transmission of acoustical and vibrational noise from the source of acoustical and vibrational energy and the information handling resource.

Technical advantages of the present disclosure may be readily apparent to one skilled in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Preferred embodiments and their advantages are best understood by reference to FIGS. 1 through 4, wherein like numbers are used to indicate like and corresponding parts.

For the purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an information handling system may be a personal computer, a PDA, a consumer electronic device, a network storage device, or any other suitable device and may vary in size, shape, performance, functionality, and price. The information handling system may include memory, one or more processing resources such as a central processing unit (CPU) or hardware or software control logic. Additional components or the information handling system may include one or more storage devices, one or more communications ports for communicating with external devices as well as various input and output (I/O) devices, such as a keyboard, a mouse, and a video display. The information handling system may also include one or more buses operable to transmit communication between the various hardware components.

For the purposes of this disclosure, information handling resources may broadly refer to any component system, device or apparatus of an information handling system, including without limitation processors, buses, memories, input-output devices and/or interfaces, storage resources, network interfaces, motherboards, integrated circuit packages; electro-mechanical devices (e.g., air movers), displays, and power supplies.

Figure 1:
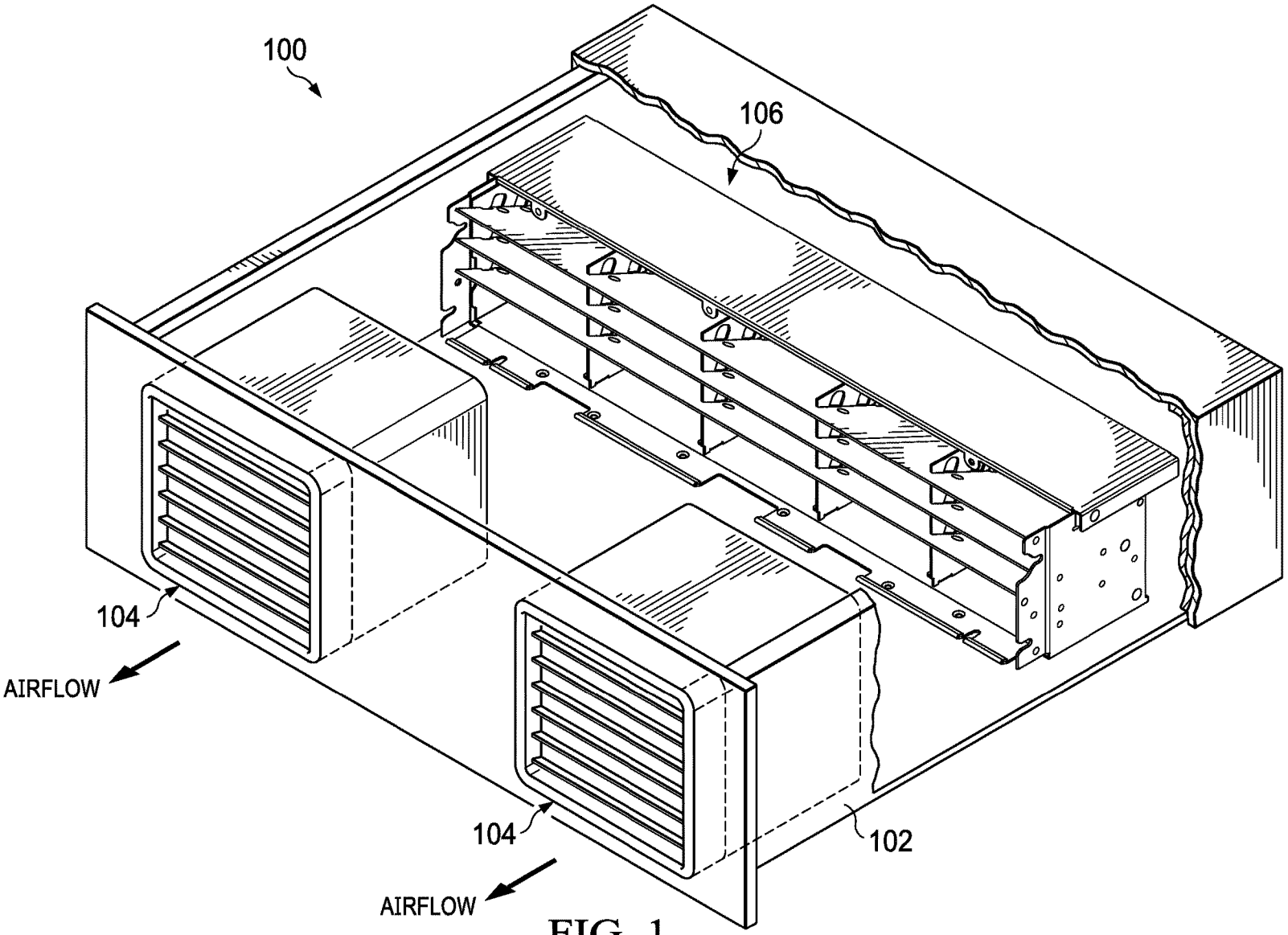
FIG. 1 illustrates a block diagram of an example information handling system having a baffle assembly for vibrational and acoustical damping in the information handling system, in accordance with the present disclosure.

FIG. 1 illustrates a block diagram of an example information handling system 100 having a baffle assembly 106 for vibrational and acoustical damping in information handling system 100, in accordance with the present disclosure. In some embodiments, an information handling system 100 may comprise a server chassis configured to house a plurality of servers or "blades." In other embodiments, information handling system 100 may comprise a personal computer (e.g., a desktop computer, laptop computer, mobile computer, and/or notebook computer). In yet other embodiments, information handling system 100 may comprise a storage enclosure configured to house a plurality of physical disk drives and/or other computer-readable media for storing data.

As depicted in FIG. 1, information handling system 100 may include a chassis 102 having a plurality of air mover assemblies 104 and baffle assembly 106. Chassis 102 may be an enclosure that serves as a container for various information handling resources of information handling system 100, and may be constructed from steel, aluminum, plastic, and/or any other suitable material. Although the term "chassis" is used, chassis 102 may also be referred to as a case, cabinet, tower, box, enclosure, and/or housing.

Each of air mover assemblies 104 may be any mechanical or electro-mechanical system, apparatus, or device operable to move air and/or other gases. In certain embodiments, air mover assemblies 104 may draw cool air into chassis 102 from the outside, expel warm air from inside chassis 102, and/or move air across one or more heatsinks (not explicitly shown) internal to chassis 102 to cool one or more information handling resources of information handling system 100.

Baffle assembly 106 may comprise a mechanical structure mechanically coupled to chassis 102 and having components arranged, as described in greater detail below, so as to permit airflow of air impelled by air mover assemblies 104 while minimizing vibrational and acoustical noise resulting from the mechanical operation of air mover assemblies 104. The structure and function of baffle assembly 106 may be described in greater detail below with respect to FIGS. 2 and 3.

Although information handling system 100 is depicted in FIG. 1 as including two air mover assemblies 104, information handling system 100 may include any suitable number of air mover assemblies 104. In addition, although a particular configuration of air mover assemblies 104 is depicted in FIG. 1, air mover assemblies 104 may be configured in any suitable manner. Further, although information handling system 100 is depicted in FIG. 1 as including a single baffle assembly 106, information handling system 100 may include any suitable number of baffle assemblies 106.

Figure 2:
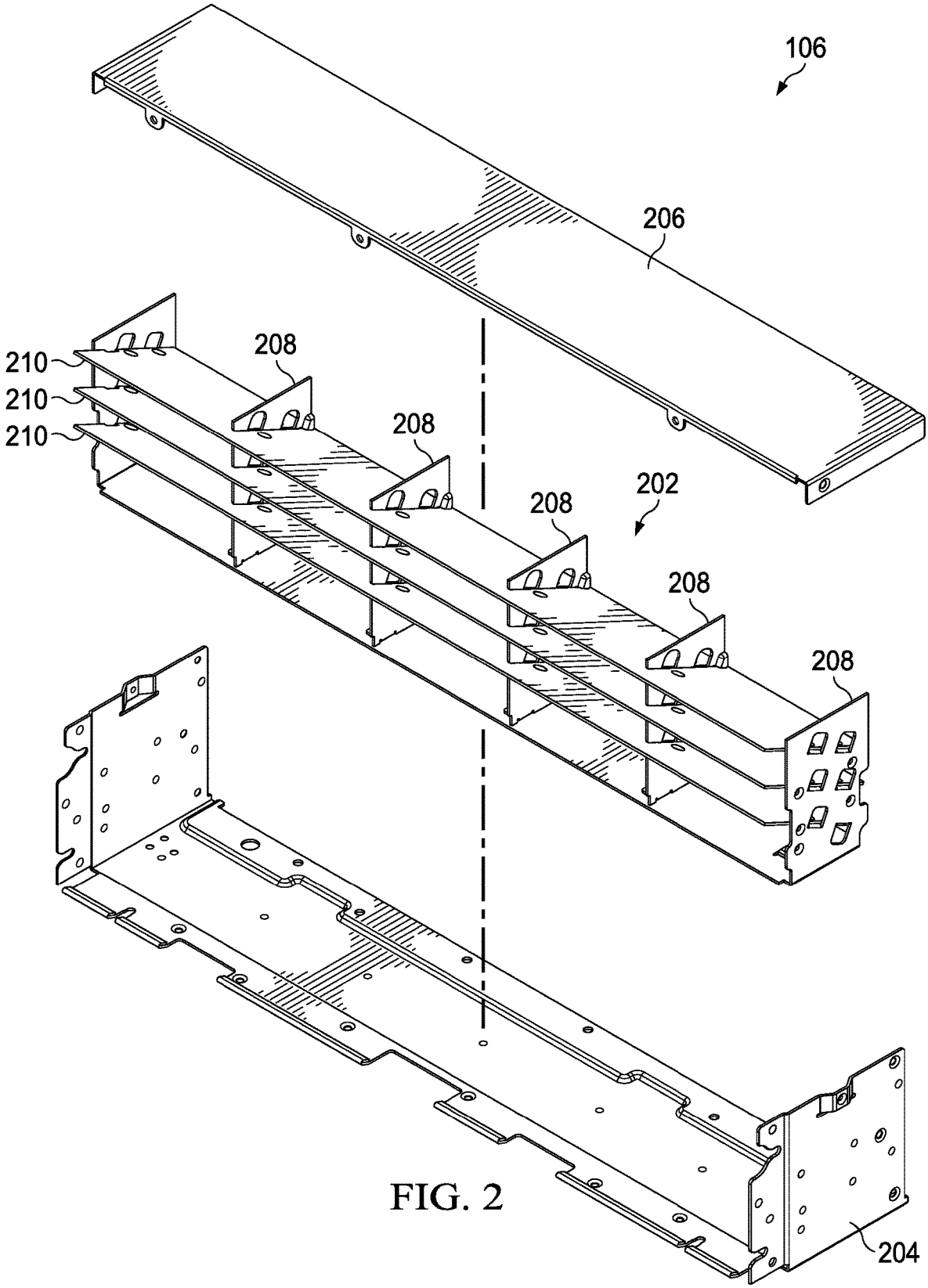
FIG. 2 illustrates an exploded perspective view of selected components of a baffle assembly for vibrational and acoustical damping in an information handling system, in accordance with the present disclosure.
Figure 3:
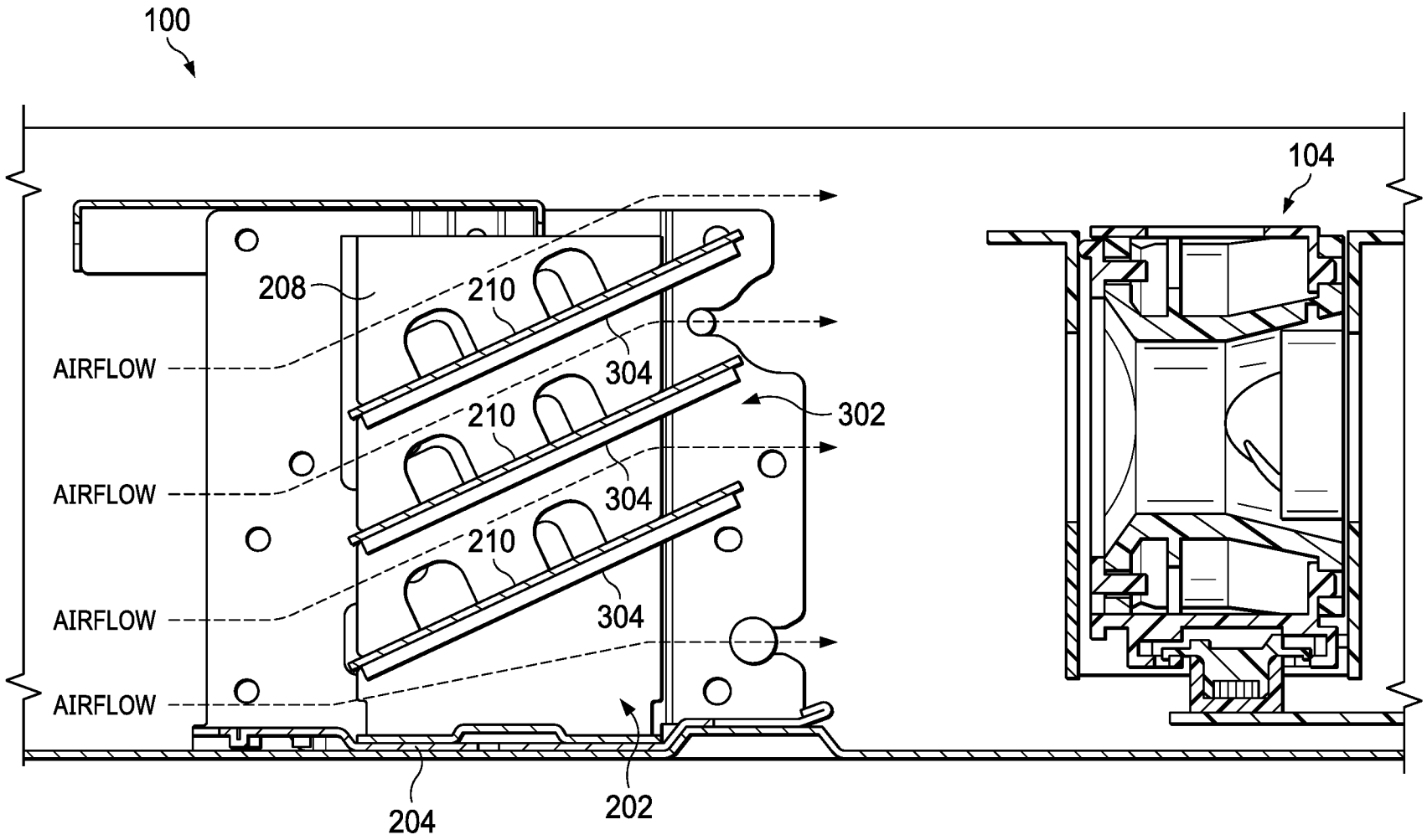
FIG. 3 illustrates a side cross-sectional elevation view of selected components of an information handling system including a baffle assembly for vibrational and acoustical damping in the information handling system, in accordance with the present disclosure.

FIG. 2 illustrates an exploded perspective view of selected components of a baffle assembly 106 for vibrational and acoustical damping in information handling system 100, in accordance with the present disclosure. FIG. 3 illustrates a side cross-sectional elevation view of selected components of information handling system 100 including baffle assembly 106 for vibrational and acoustical damping in information handling system 100, in accordance with the present disclosure.

As shown in FIGS. 2 and 3, baffle assembly 106 may include a baffle structure 202, a bottom bracket 204, and a top bracket 206. When assembled, baffle structure 202 may be mechanically coupled to bottom bracket 204 and top bracket 206 via fasteners and/or tool-less retention features. In turn, features of bottom bracket 204 and/or top bracket 206 may be configured to mechanically couple to corresponding features of chassis 102, to mechanically secure baffle assembly 106 within chassis 102.

Baffle structure 202 may comprise a plurality of spaced divider walls 208 generally parallel with respect to one another and oriented such that they are generally parallel to the direction of airflow when baffle assembly 106 is placed in chassis 102. Divider walls 208 may comprise any suitable material, including without limitation, metal. In some embodiments, divider walls 208 may be spaced from one another to achieve frequency-specific vibration reduction at one or more targeted vibrational frequencies.

Baffle structure 202 may also include a plurality of baffle fins 210 mechanically mounted to divider walls 208 in a manner such that baffle fins 210 are generally parallel to one another, generally perpendicular to divider walls 208, and angled such that they are substantially non-parallel to the direction of airflow when baffle assembly 106 is placed in chassis 102. Baffle fins 210 may comprise any suitable material, including without limitation, metal. As shown in FIG. 3, adjacent baffle fins 210 may have an overlap 302 in the direction of airflow between a leading edge of one baffle fin 210 of the adjacent baffle fins 210 and the following edge of the other baffle fin 210 of the adjacent baffle fins 210, and baffle assembly 106 may be located between air mover assembly 104 and "upstream" components (e.g., hard disk drives) of information handling system 100, such that overlap 302 may block an acoustic "line of sight" between air mover assembly 104 and such upstream components. In addition or alternatively, each baffle fin 210 may have formed thereon a layer 304 of acoustically-absorbent material, such as foam, which may reduce acoustic and vibrational energy passing through or reflecting off of baffle fins 210. In some embodiments, one or more layers 304 of acoustically-absorbent material may be formed on divider walls 208, bottom bracket 202, and/or top bracket 204 in addition to or in lieu of such material being formed on baffle fins 210.

Figure 4:
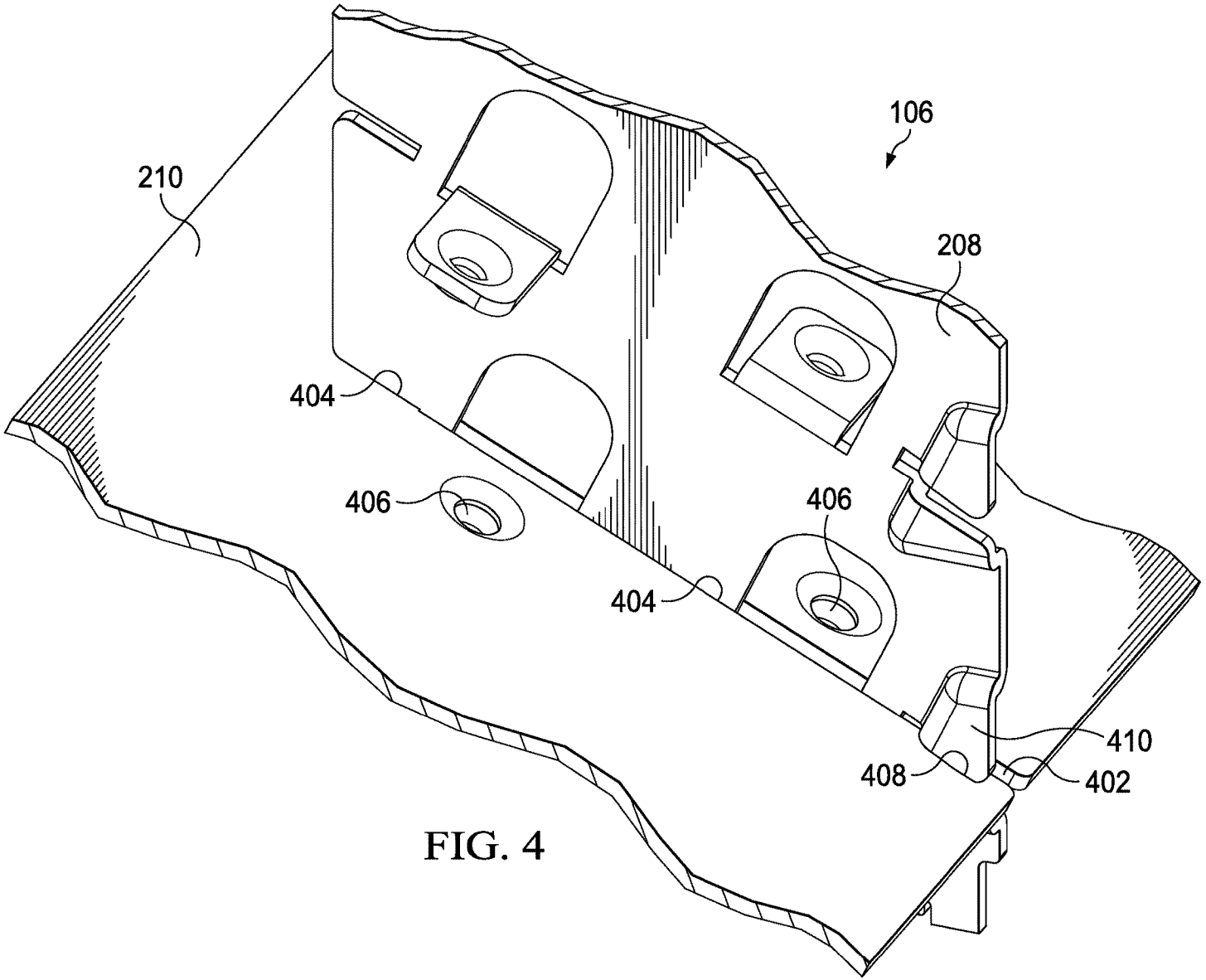
FIG. 4 illustrates a perspective close-up view of selected components of a baffle assembly for vibrational and acoustical damping in the information handling system, in accordance with the present disclosure.

FIG. 4 illustrates a perspective close-up view of selected components of baffle assembly 106, in accordance with the present disclosure. As shown in FIG. 4, baffle fins 210 may include slots 402 or other features for receiving counterpart features 404 of divider walls 208. Mechanical fasteners 406 may also ensure rigid mechanical coupling of divider walls 208 to baffle fins 210. Such rigid coupling may push up vibrational modes of baffle assembly 106 to higher frequencies that may be of lesser concern for causing vibrational and acoustical noise. Furthermore, as suggested above, slots 402 may be located along baffle fins 210 such that when assembled, divider walls 208 are spaced relative to one another to create vibrational anti-nodes at desired locations within baffle assembly 106 (e.g., at locations at which most vibrational energy may exist in the absence of divider walls).

In addition, a mechanical interference may be formed between a feature 410 (e.g., flange) of divider wall 208 and corresponding feature 408 (e.g., a slot pre-bend) of baffle fin 210, wherein such mechanical interference may create a stiff mechanical coupling between divider wall 208 and baffle fin 210 at the location of the interference, further minimizing mechanical vibration.

Although the foregoing contemplates using baffle assembly 106 to minimize vibrational and acoustical noise resulting from an air mover, the systems and methods herein may be used to minimize vibrational and acoustical noise resulting from any acoustical and/or vibrational energy source.

As used herein, when two or more elements are referred to as "coupled" to one another, such term indicates that such two or more elements are in electronic communication or mechanical communication, as applicable, whether connected indirectly or directly, with or without intervening elements.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative. Accordingly, modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

Although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described above.

Unless otherwise specifically noted, articles depicted in the drawings are not necessarily drawn to scale.

All examples and conditional language recited herein are intended for pedagogical objects to aid the reader in understanding the disclosure and the concepts contributed by the inventor to furthering the art, and are construed as being without limitation to such specifically recited examples and conditions. Although embodiments of the present disclosure have been described in detail, it should be understood that various changes, substitutions, and alterations could be made hereto without departing from the spirit and scope of the disclosure.

Although specific advantages have been enumerated above, various embodiments may include some, none, or all of the enumerated advantages. Additionally, other technical advantages may become readily apparent to one of ordinary skill in the art after review of the foregoing figures and description.

To aid the Patent Office and any readers of any patent issued on this application in interpreting the claims appended hereto, applicants wish to note that they do not intend any of the appended claims or claim elements to invoke 35 U.S.C. § 112(f) unless the words "means for" or "step for" are explicitly used in the particular claim.

What is claimed is:

1. An information handling system comprising:

a chassis; and an acoustical/vibrational noise reduction system mechanically coupled within the chassis and located between a source of acoustical and vibrational energy and an information handling resource of the information handling system, the acoustical/vibrational noise reduction system comprising:

a plurality of divider walls spaced from each other, generally parallel to each other, and generally parallel to a direction of transmission of acoustical and vibrational noise from the source of acoustical and vibrational energy and the information handling resource; and a plurality of baffle fins mechanically coupled to the plurality of divider walls, generally perpendicular to the plurality of divider walls, and substantially non-parallel to the direction of transmission of acoustical and vibrational noise from the source of acoustical and vibrational energy and the information handling resource;

wherein the plurality of baffle fins are comprised of metal and wherein a layer of acoustically-absorbent material is formed on at least one of the plurality of baffle fins.

2. The information handling system of claim 1, wherein the plurality of baffle fins are arranged such that a leading edge of a first baffle fin and a trailing edge of a second baffle fin adjacent to the first baffle fin overlap in the direction of transmission of acoustical and vibrational noise from the source of acoustical and vibrational energy and the information handling resource.

3. The information handling system of claim 1, wherein a layer of acoustically-absorbent material is formed on at least one of the plurality of divider walls.

4. The information handling system of claim 3, wherein the acoustically-absorbent material comprises foam.

5. The information handling system of claim 1, wherein the plurality of divider walls are spaced from one another to achieve frequency-specific vibration reduction at one or more targeted vibrational frequencies.

6. The information handling system of claim 1, wherein the source of acoustical and vibrational energy comprises at least one air mover.

7. The information handling system of claim 6, wherein the direction of transmission of acoustical and vibrational noise from the source of acoustical and vibrational energy and the information handling resource comprises a direction of airflow impelled by the at least one air mover.

8. An acoustical/vibrational noise reduction system comprising:

a plurality of divider walls spaced from each other, generally parallel to each other, and generally parallel to a direction of transmission of acoustical and vibrational noise from a source of acoustical and vibrational energy and an information handling resource; and a plurality of baffle fins mechanically coupled to the plurality of divider walls, generally perpendicular to the plurality of divider walls, and substantially non-parallel to the direction of transmission of acoustical and vibrational noise from the source of acoustical and vibrational energy and the information handling resources;

wherein the plurality of baffle fins are comprised of metal and wherein a layer of acoustically-absorbent material is formed on at least one of the plurality of baffle fins.

9. The acoustical/vibrational noise reduction system of claim 8, wherein the plurality of baffle fins are arranged such that a leading edge of a first baffle fin and a trailing edge of a second baffle fin adjacent to the first baffle fin overlap in the direction of transmission of acoustical and vibrational noise from the source of acoustical and vibrational energy and the information handling resource.

10. The acoustical/vibrational noise reduction system of claim 8, wherein a layer of acoustically-absorbent material is formed on at least one of the plurality of divider walls.

11. The acoustical/vibrational noise reduction system of claim 10, wherein the acoustically-absorbent material comprises foam.

12. The acoustical/vibrational noise reduction system of claim 8, wherein the plurality of divider walls are spaced from one another to achieve frequency-specific vibration reduction at one or more targeted vibrational frequencies.

13. The acoustical/vibrational noise reduction system of claim 8, wherein the source of acoustical and vibrational energy comprises at least one air mover.

14. The acoustical/vibrational noise reduction system of claim 13, wherein the direction of transmission of acoustical and vibrational noise from the source of acoustical and vibrational energy and the information handling resource comprises a direction of airflow impelled by the at least one air mover.

15. A method comprising:

arranging a plurality of divider walls spaced from each other, generally parallel to each other, and generally parallel to a direction of transmission of acoustical and vibrational noise from a source of acoustical and vibrational energy and an information handling resource; and mechanically coupling a plurality of baffle fins to the plurality of divider walls, generally perpendicular to the plurality of divider walls, and substantially non-parallel to the direction of transmission of acoustical and vibrational noise from the source of acoustical and vibrational energy and the information handling resources;

wherein the plurality of baffle fins are comprised of metal and wherein a layer of acoustically-absorbent material is formed on at least one of the plurality of baffle fins.

16. The method of claim 15, further comprising arranging the plurality of baffle fins such that a leading edge of a first baffle fin and a trailing edge of a second baffle fin adjacent to the first baffle fin overlap in the direction of transmission of acoustical and vibrational noise from the source of acoustical and vibrational energy and the information handling resource.

17. The method of claim 15, further comprising forming a layer of acoustically-absorbent material on at least one of the plurality of divider walls.

18. The method of claim 17, wherein the acoustically-absorbent material comprises foam.

19. The method of claim 15, further comprising spacing the plurality of divider walls from one another to achieve frequency-specific vibration reduction at one or more targeted vibrational frequencies.

20. The method of claim 15, wherein the source of acoustical and vibrational energy comprises at least one air mover.

21. The method of claim 20, wherein the direction of transmission of acoustical and vibrational noise from the source of acoustical and vibrational energy and the information handling resource comprises a direction of airflow impelled by the at least one air mover.

* * * * *